US011280066B2

(12) United States Patent
Muraoka et al.

(10) Patent No.: US 11,280,066 B2
(45) Date of Patent: Mar. 22, 2022

(54) HYDRAULIC DRIVE SYSTEM OF CONSTRUCTION MACHINE

(71) Applicant: KAWASAKI JUKOGYO KABUSHIKI KAISHA, Kobe (JP)

(72) Inventors: Hideyasu Muraoka, Akashi (JP); Tomomichi Nose, Akashi (JP); Nobuyuki Kinoshita, Kakogawa (JP); Takashi Okashiro, Kakogawa (JP); Moriyuki Sakamoto, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/767,638

(22) PCT Filed: May 21, 2018

(86) PCT No.: PCT/JP2018/019516
§ 371 (c)(1),
(2) Date: May 28, 2020

(87) PCT Pub. No.: WO2019/224879
PCT Pub. Date: Nov. 28, 2019

(65) Prior Publication Data
US 2021/0002867 A1 Jan. 7, 2021

(51) Int. Cl.
*E02F 9/22* (2006.01)

(52) U.S. Cl.
CPC ..... *E02F 9/2296* (2013.01); *E02F 9/2285* (2013.01); *E02F 9/2235* (2013.01);
(Continued)

(58) Field of Classification Search
CPC ..... E02F 9/2296; E02F 9/2285; E02F 9/2235; E02F 9/2267; F15B 2211/6652
See application file for complete search history.

(56) References Cited

U.S. PATENT DOCUMENTS 6,375,433 B1 * 4/2002 Du ..... F04B 1/324 417/53

FOREIGN PATENT DOCUMENTS

JP S56-059003 A 5/1981
JP H06-330902 A 11/1994
(Continued)

*Primary Examiner* — Michael Leslie
*Assistant Examiner* — Daniel S Collins
(74) *Attorney, Agent, or Firm* — Oliff PLC

(57) ABSTRACT

A hydraulic drive system of construction machine including: turning motor; turning operation device that outputs turning operation signal corresponding to inclination angle of operating lever; turning direction switching valve including spool and driver, driver receiving command current and driving spool, turning direction switching valve increasing amount of hydraulic liquid supplied to turning motor and amount of hydraulic liquid discharged from turning motor with increase in command current; controller that feeds command current to turning direction switching valve, wherein command current increases in accordance with increase in turning operation signal; and pressure sensor that detects outflow pressure of turning motor. Where turning operation signal decreases, when outflow pressure of turning motor, which is detected by pressure sensor, is higher than threshold and is increasing, controller feeds command current to turning direction switching valve, wherein a moving speed of spool is kept to be less than or equal to limiting value.

10 Claims, 6 Drawing Sheets

(52) U.S. Cl.
CPC ..... *E02F 9/2267* (2013.01); *F15B 2211/6316* (2013.01); *F15B 2211/6346* (2013.01); *F15B 2211/6652* (2013.01)

(56) References Cited

FOREIGN PATENT DOCUMENTS

| | | | |
|---|---|---|---|
| JP | H08-105076 | A | 4/1996 |
| JP | H08-199631 | A | 8/1996 |
| JP | H08-333778 | A | 12/1996 |
| JP | H10-299703 | A | 11/1998 |
| JP | 2001-254702 | A | 9/2001 |
| JP | 2013-234683 | A | 11/2013 |
| JP | 2014-222103 | A | 11/2014 |

* cited by examiner

HYDRAULIC DRIVE SYSTEM OF CONSTRUCTION MACHINE

TECHNICAL FIELD

The present invention relates to a hydraulic drive system of a construction machine.

BACKGROUND ART

In a construction machine such as a hydraulic excavator or hydraulic crane, a hydraulic drive system including a turning motor is installed (see Patent Literature 1, for example). The turning motor is supplied with a hydraulic liquid from a pump via a turning direction switching valve.

Specifically, the turning direction switching valve is connected to the turning motor by a pair of supply/discharge lines. The pressure of each of the pair of supply/discharge lines is kept to be lower than or equal to an upper limit pressure by a relief valve. The turning direction switching valve increases the amount of hydraulic liquid supplied to the turning motor and the amount of hydraulic liquid discharged from the turning motor in accordance with increase in an inclination angle of an operating lever of a turning operation device (i.e., in accordance with increase in a turning operation amount).

CITATION LIST

Patent Literature

PTL 1: Japanese Laid-Open Patent Application Publication No. 2001-254702

SUMMARY OF INVENTION

Technical Problem

At the time of turning acceleration, if the inflow pressure of the turning motor rapidly rises to the upper limit pressure defined by the relief valve, a shock may occur when the inflow pressure of the turning motor reaches the upper limit pressure. Also, at the time of turning deceleration, if the outflow pressure of the turning motor rapidly rises to the upper limit pressure defined by the relief valve, a shock may occur when the outflow pressure of the turning motor reaches the upper limit pressure.

In order to reduce such a shock, it is conceivable to use, as the above relief valve, a relief valve having a pressure increase shock reducing function as disclosed by Patent Literature 1. Such a relief valve having a pressure increase shock reducing function does not regulate the rate of change in primary pressure (inlet pressure) until the primary pressure becomes a setting value, and when the primary pressure increases from the setting value, causes the primary pressure to increase slowly to the upper limit value.

However, a relief valve having such a pressure increase shock reducing function is complex in structure, and therefore large in size and high in cost.

In view of the above, an object of the present invention is to make it possible to reduce a shock occurring at the time of turning acceleration and/or at the time of turning deceleration, without using a relief valve having a pressure increase shock reducing function.

Solution to Problem

In order to solve the above-described problems, one aspect of the present invention provides a hydraulic drive system of a construction machine, the hydraulic drive system including: a turning motor; a turning operation device including an operating lever, the turning operation device outputting a turning operation signal corresponding to an inclination angle of the operating lever; a turning direction switching valve including a spool and a driver, the driver receiving a command current and driving the spool, the turning direction switching valve increasing an amount of a hydraulic liquid supplied to the turning motor and an amount of the hydraulic liquid discharged from the turning motor in accordance with increase in the command current; a controller that feeds the command current to the turning direction switching valve, such that the command current increases in accordance with increase in the turning operation signal; and a pressure sensor that detects an outflow pressure of the turning motor. In a case where the turning operation signal decreases, when the outflow pressure of the turning motor, which is detected by the pressure sensor, is higher than a threshold and is increasing, the controller feeds the command current to the turning direction switching valve, such that a moving speed of the spool is kept to be less than or equal to a limiting value.

According to the above configuration, at the time of turning deceleration (i.e., in a case where the turning operation signal decreases), if the outflow pressure of the turning motor becomes higher than or equal to the threshold, the closing action of the turning direction switching valve in response to the turning operation signal is delayed. Therefore, the outflow pressure of the turning motor increases slowly from the threshold to the upper limit pressure. This makes it possible to reduce a shock occurring at the time of turning deceleration without using a relief valve having a pressure increase shock reducing function.

The controller may adjust the limiting value by feedforward control or feedback control based on the outflow pressure of the turning motor, which is detected by the pressure sensor. According to this configuration, a shock occurring at the time of turning deceleration can be reduced more effectively.

The above-described hydraulic drive system may further include: a variable displacement pump connected to the turning direction switching valve by a supply line; a flow rate adjuster that adjusts a tilting angle of the pump; and a pressure sensor that detects a delivery pressure of the pump or an inflow pressure of the turning motor. The controller may control the flow rate adjuster, such that a delivery flow rate of the pump increases in accordance with increase in the turning operation signal. In a case where the turning operation signal increases, when the delivery pressure of the pump or the inflow pressure of the turning motor, which is detected by the pressure sensor, is higher than a threshold, the controller may control the flow rate adjuster, such that a rate of change in the tilting angle of the pump, or a command value of the tilting angle of the pump, is kept to be less than or equal to a limiting value. According to this configuration, at the time of turning acceleration (i.e., in a case where the turning operation signal increases), if the delivery pressure of the pump or the inflow pressure of the turning motor becomes higher than or equal to the threshold, the rising of the delivery flow rate of the pump in response to the turning operation signal is delayed. Therefore, the inflow pressure of the turning motor increases slowly from the threshold to the upper limit pressure. This makes it possible to reduce a shock occurring at the time of turning acceleration without using a relief valve having a pressure increase shock reducing function.

Alternatively, the above hydraulic drive system may further include: a variable displacement pump connected to the turning direction switching valve by a supply line; a flow rate adjuster that adjusts a tilting angle of the pump; an unloading valve provided on an unloading line that is branched off from the supply line; and a pressure sensor that detects a delivery pressure of the pump or an inflow pressure of the turning motor. The controller may control the flow rate adjuster such that a delivery flow rate of the pump increases in accordance with increase in the turning operation signal, and control the unloading valve such that an opening degree of the unloading valve decreases in accordance with increase in the turning operation signal. In a case where the turning operation signal increases, when the delivery pressure of the pump or the inflow pressure of the turning motor, which is detected by the pressure sensor, is higher than a threshold, the controller may control the unloading valve, such that a rate of change in the opening degree of the unloading valve, or a command value of the opening degree of the unloading valve, is kept to be less than or equal to a limiting value. According to this configuration, at the time of turning acceleration (i.e., in a case where the turning operation signal increases), if the delivery pressure of the pump or the inflow pressure of the turning motor becomes higher than or equal to the threshold, the closing action of the unloading valve in response to the turning operation signal is delayed, and the rising of the amount of hydraulic liquid supplied to the turning motor is delayed. Therefore, the inflow pressure of the turning motor increases slowly from the threshold to the upper limit pressure. This makes it possible to reduce a shock occurring at the time of turning acceleration without using a relief valve having a pressure increase shock reducing function.

Another aspect of the present invention provides a hydraulic drive system of a construction machine, the hydraulic drive system including: a turning motor; a turning operation device including an operating lever, the turning operation device outputting a turning operation signal corresponding to an inclination angle of the operating lever; a turning direction switching valve that increases an amount of a hydraulic liquid supplied to the turning motor and an amount of the hydraulic liquid discharged from the turning motor in accordance with increase in the turning operation signal; a variable displacement pump connected to the turning direction switching valve by a supply line; a flow rate adjuster that adjusts a tilting angle of the pump; a controller that controls the flow rate adjuster, such that a delivery flow rate of the pump increases in accordance with increase in the turning operation signal; and a pressure sensor that detects a delivery pressure of the pump or an inflow pressure of the turning motor. In a case where the turning operation signal increases, when the delivery pressure of the pump or the inflow pressure of the turning motor, which is detected by the pressure sensor, is higher than a threshold, the controller controls the flow rate adjuster, such that a rate of change in the tilting angle of the pump, or a command value of the tilting angle of the pump, is kept to be less than or equal to a limiting value.

According to the above configuration, at the time of turning acceleration (i.e., in a case where the turning operation signal increases), if the delivery pressure of the pump or the inflow pressure of the turning motor becomes higher than or equal to the threshold, the rising of the delivery flow rate of the pump in response to the turning operation signal is delayed. Therefore, the inflow pressure of the turning motor increases slowly from the threshold to the upper limit pressure. This makes it possible to reduce a shock occurring at the time of turning acceleration without using a relief valve having a pressure increase shock reducing function.

The controller may adjust the limiting value by feedforward control or feedback control based on the delivery pressure of the pump or the inflow pressure of the turning motor, which is detected by the pressure sensor. According to this configuration, a shock occurring at the time of turning acceleration can be reduced more effectively.

Yet another aspect of the present invention provides a hydraulic drive system of a construction machine, the hydraulic drive system including: a turning motor; a turning operation device including an operating lever, the turning operation device outputting a turning operation signal corresponding to an inclination angle of the operating lever; a turning direction switching valve that increases an amount of a hydraulic liquid supplied to the turning motor and an amount of the hydraulic liquid discharged from the turning motor in accordance with increase in the turning operation signal; a variable displacement pump connected to the turning direction switching valve by a supply line; a flow rate adjuster that adjusts a tilting angle of the pump; an unloading valve provided on an unloading line that is branched off from the supply line; a controller that controls the flow rate adjuster such that a delivery flow rate of the pump increases in accordance with increase in the turning operation signal, and controls the unloading valve such that an opening degree of the unloading valve decreases in accordance with increase in the turning operation signal; and a pressure sensor that detects a delivery pressure of the pump or an inflow pressure of the turning motor. In a case where the turning operation signal increases, when the delivery pressure of the pump or the inflow pressure of the turning motor, which is detected by the pressure sensor, is higher than a threshold, the controller controls the unloading valve, such that a rate of change in the opening degree of the unloading valve, or a command value of the opening degree of the unloading valve, is kept to be less than or equal to a limiting value.

According to the above configuration, at the time of turning acceleration (i.e., in a case where the turning operation signal increases), if the delivery pressure of the pump or the inflow pressure of the turning motor becomes higher than or equal to the threshold, the closing action of the unloading valve in response to the turning operation signal is delayed, and the rising of the amount of hydraulic liquid supplied to the turning motor is delayed. Therefore, the inflow pressure of the turning motor increases slowly from the threshold to the upper limit pressure. This makes it possible to reduce a shock occurring at the time of turning acceleration without using a relief valve having a pressure increase shock reducing function.

The controller may adjust the limiting value by feedforward control or feedback control based on the delivery pressure of the pump or the inflow pressure of the turning motor, which is detected by the pressure sensor. According to this configuration, a shock occurring at the time of turning acceleration can be reduced more effectively.

Advantageous Effects of Invention

The present invention makes it possible to reduce a shock occurring at the time of turning acceleration and/or at the time of turning deceleration, without using a relief valve having a pressure increase shock reducing function.

BRIEF DESCRIPTION OF DRAWINGS

FIG. 3A shows temporal changes in a turning operation signal; FIG. 3B shows temporal changes in the tilting angle of a pump; FIG. 3C shows temporal changes in the inflow pressure of a turning motor; and FIG. 3D shows temporal changes in a turning speed.

FIG. 4A shows temporal changes in the turning operation signal; FIG. 4B shows temporal changes in the spool displacement of a turning direction switching valve; FIG. 4C shows temporal changes in the outflow pressure of the turning motor; and FIG. 4D shows temporal changes in the turning speed.

FIG. 6A shows temporal changes in the turning operation signal; FIG. 6B shows temporal changes in the opening degree of an unloading valve; FIG. 6C shows temporal changes in the inflow pressure of the turning motor; and FIG. 6D shows temporal changes in the turning speed.

DESCRIPTION OF EMBODIMENTS

Embodiment 1

Figure 1:
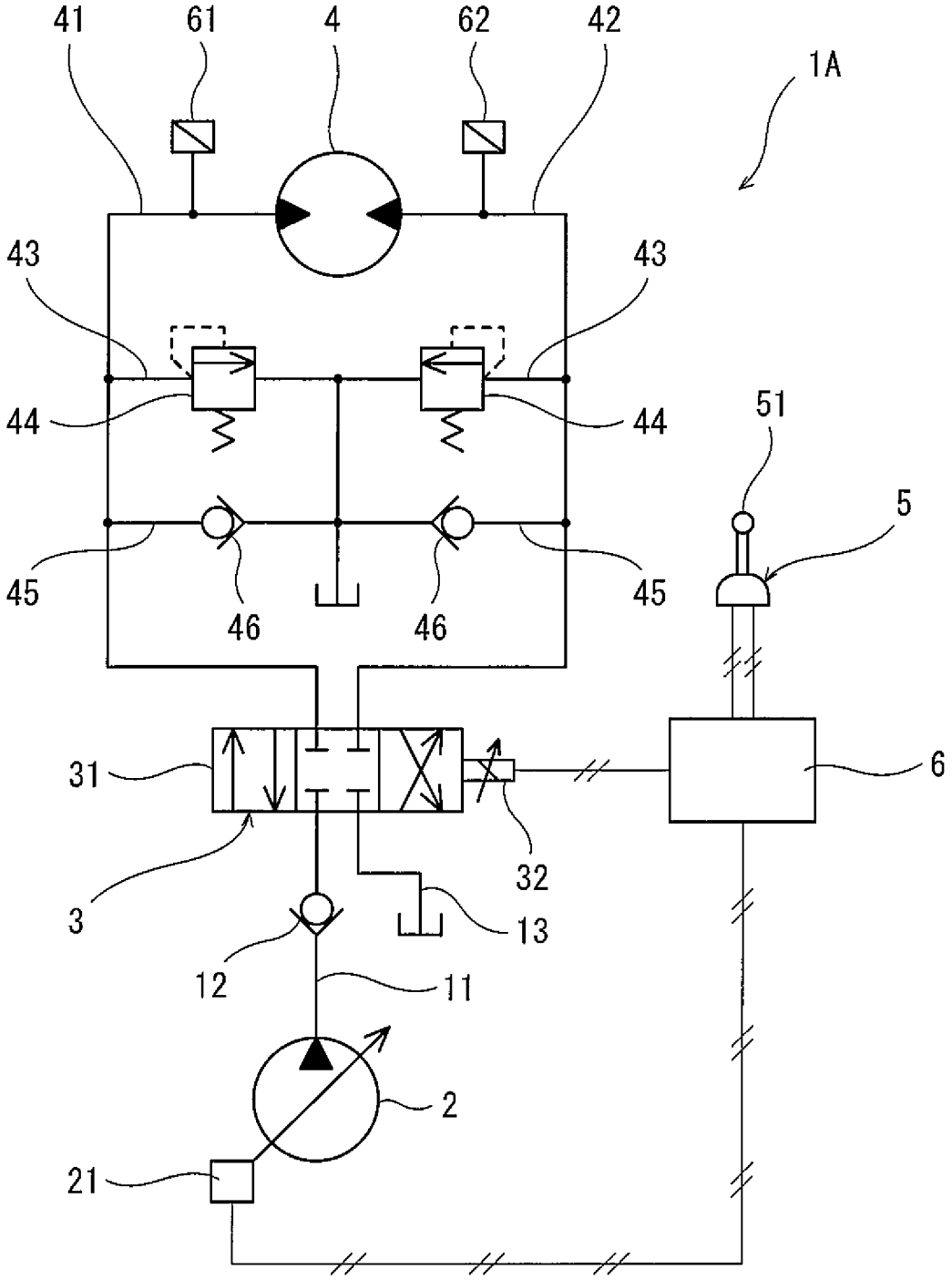
FIG. 1 shows a schematic configuration of a hydraulic drive system of a construction machine according to Embodiment 1 of the present invention.
Figure 2:
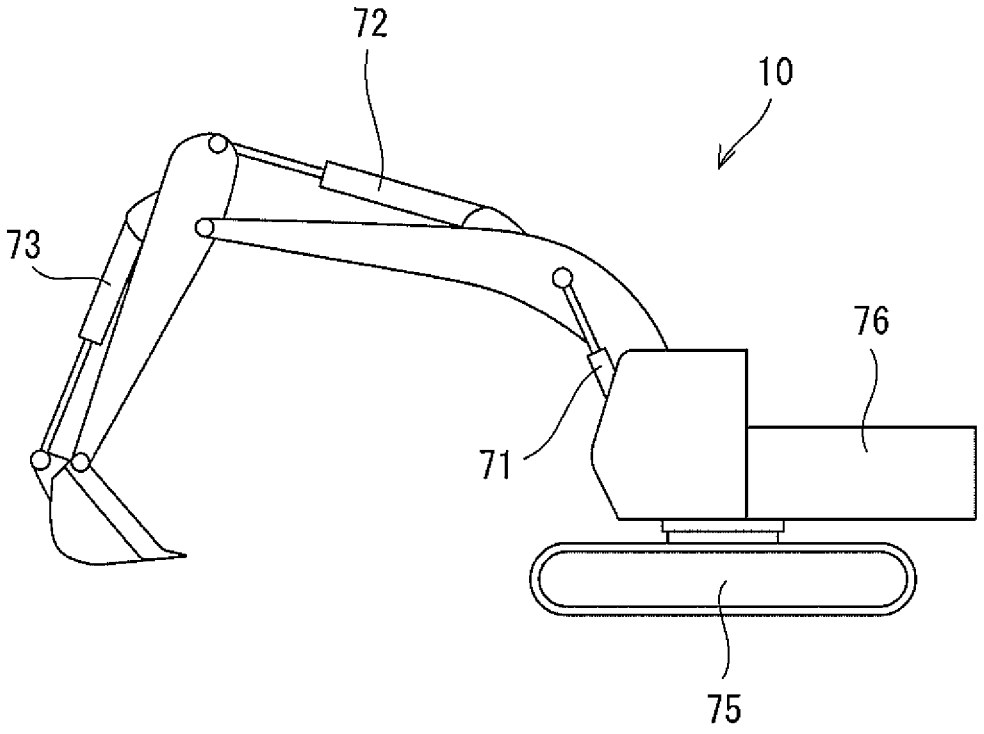
FIG. 2 is a side view of a hydraulic excavator that is one example of the construction machine.

FIG. 1 shows a hydraulic drive system 1A of a construction machine according to Embodiment 1 of the present invention. FIG. 2 shows a construction machine 10, in which the hydraulic drive system 1A is installed. Although the construction machine 10 shown in FIG. 2 is a hydraulic excavator, the present invention is also applicable to other construction machines, such as a hydraulic crane.

The construction machine 10 shown in FIG. 2 is of a self-propelled type, and includes: a running unit 75; and a turning unit 76 turnably supported by the running unit 75. The turning unit 76 is equipped with a cabin including an operator's seat. A boom is coupled to the turning unit 76. An arm is coupled to the distal end of the boom, and a bucket is coupled to the distal end of the arm. However, the construction machine 10 need not be of a self-propelled type.

The hydraulic drive system 1A includes, as hydraulic actuators, a boom cylinder 71, an arm cylinder 72, and a bucket cylinder 73, which are shown in FIG. 2, a turning motor 4 shown in FIG. 1, and a pair of unshown right and left running motors. The turning motor 4 turns the turning unit 76. As shown in FIG. 1, the hydraulic drive system 1A further includes a pump 2, which supplies a hydraulic liquid to these actuators. It should be noted that, in FIG. 1, the hydraulic actuators other than the turning motor 4 are not shown for the purpose of simplifying the drawing.

The hydraulic drive system 1A further includes: a turning direction switching valve 3, which controls the supply and discharge of the hydraulic liquid to and from the turning motor 4; a turning operation device 5 including an operating lever 51, which receives a turning operation; and a controller 6.

The pump 2 is a variable displacement pump whose tilting angle is changeable. The pump 2 may be a swash plate pump or a bent axis pump. The tilting angle of the pump 2 is adjusted by a flow rate adjuster 21. For example, in a case where the pump 2 is a swash plate pump, the flow rate adjuster 21 includes: a regulator that swings the swash plate of the pump 2; and a solenoid proportional valve that outputs a secondary pressure to the regulator.

The pump 2 is connected to the turning direction switching valve 3 by a supply line 11. The supply line 11 is provided with a check valve 12. The delivery pressure of the pump 2 is kept to be lower than or equal to a first upper limit pressure by an unshown relief valve. The turning direction switching valve 3 is connected to a tank by a tank line 13.

The turning direction switching valve 3 is further connected to the turning motor 4 by a pair of supply/discharge lines 41 and 42. Relief lines 43 are branched off from the respective supply/discharge lines 41 and 42, and connect to the tank. The relief lines 43 are provided with respective relief valves 44. That is, the pressure of each of the supply/discharge lines 41 and 42 is kept to be lower than or equal to a second upper limit pressure by a corresponding one of the relief valves 44. It should be noted that the second upper limit pressure may be equal to or different from the aforementieod first upper limit pressure.

The supply/discharge lines 41 and 42 are connected to the tank by respective make-up lines 45. Each of the make-up lines 45 is provided with a check valve 46, which allows a flow toward the supply/discharge line (41 or 42) and prevents the reverse flow.

In the present embodiment, the turning direction switching valve 3 is driven by an electrical signal. Specifically, the turning direction switching valve 3 includes a spool 31 and a driver 32. The driver 32 receives a command current and drives the spool 31. For example, the driver 32 may be constituted by a pair of solenoid proportional valves, each of which outputs a secondary pressure. The secondary pressure outputted from one of the solenoid proportional valves, and the secondary pressure outputted from the other solenoid proportional valve, are applied to the spool 31 in opposite directions to each other. Alternatively, the driver 32 may be a linear motion mechanism that is coupled to the spool 31 and that includes, for example, an electric motor and a ball screw. The turning direction switching valve 3 increases the amount of hydraulic liquid supplied to the turning motor 4 and the amount of hydraulic liquid discharged from the turning motor 4 in accordance with increase in the command current fed to the driver 32.

The turning operation device 5 outputs a turning operation signal (right turning operation signal or left turning operation signal) corresponding to an inclination angle (turning operation amount) of the operating lever 51. That is, the turning operation signal outputted from the turning operation device 5 increases in accordance with increase in the inclination angle of the operating lever 51. In the present embodiment, the turning operation device 5 is an electrical joystick that outputs an electrical signal as the turning operation signal.

The turning operation signal (electrical signal) outputted from the turning operation device 5 is inputted to the controller 6. For example, the controller 9 includes a CPU and memories, such as a ROM and RAM. The CPU executes a program stored in the ROM.

The controller 6 feeds the command current to the driver 32 of the turning direction switching valve 3, such that the command current increases in accordance with increase in the turning operation signal. Accordingly, the greater the inclination angle of the operating lever 51 of the turning operation device 5, the more the spool 31 of the turning direction switching valve 3 moves.

The controller 6 also controls the flow rate adjuster 21. To be more specific, the controller 6 controls the flow rate adjuster 21, such that the delivery flow rate of the pump 2 (i.e., the tilting angle of the pump 2) increases in accordance with increase in the turning operation signal.

The controller 6 is electrically connected to pressure sensors 61 and 62, which are provided on the supply/discharge lines 41 and 42, respectively. It should be noted that FIG. 1 shows only part of signal lines for simplifying the drawing. In the present embodiment, at the time of left turning, the supply/discharge line 41 serves as the supply-side line, and at the time of right turning, the supply/discharge line 42 serves as the supply-side line. Accordingly, at the time of left turning, the pressure sensor 61 detects the inflow pressure of the turning motor 4, and the pressure sensor 62 detects the outflow pressure of the turning motor 4. On the other hand, at the time of right turning, the pressure sensor 62 detects the inflow pressure of the turning motor 4, and the pressure sensor 61 detects the outflow pressure of the turning motor 4.

In the present embodiment, the controller 6 performs both acceleration shock reducing control and deceleration shock reducing control. The acceleration shock reducing control is the control for reducing a shock occurring at the time of turning acceleration. The deceleration shock reducing control is the control for reducing a shock occurring at the time of turning deceleration. Hereinafter, the acceleration shock reducing control and the deceleration shock reducing control are described separately.

(1) Acceleration Shock Reducing Control

First, the controller 6 determines whether the turning operation signal outputted from the turning operation device 5 increases or not. When the turning operation signal increases, the controller 6 increases the amount of displacement of the spool 31 of the turning direction switching valve 3 from the neutral position. Accordingly, as shown in FIG. 3D, the turning speed of the construction machine 10 increases gradually.

Figures 3A, 3B, 3C, 3D:
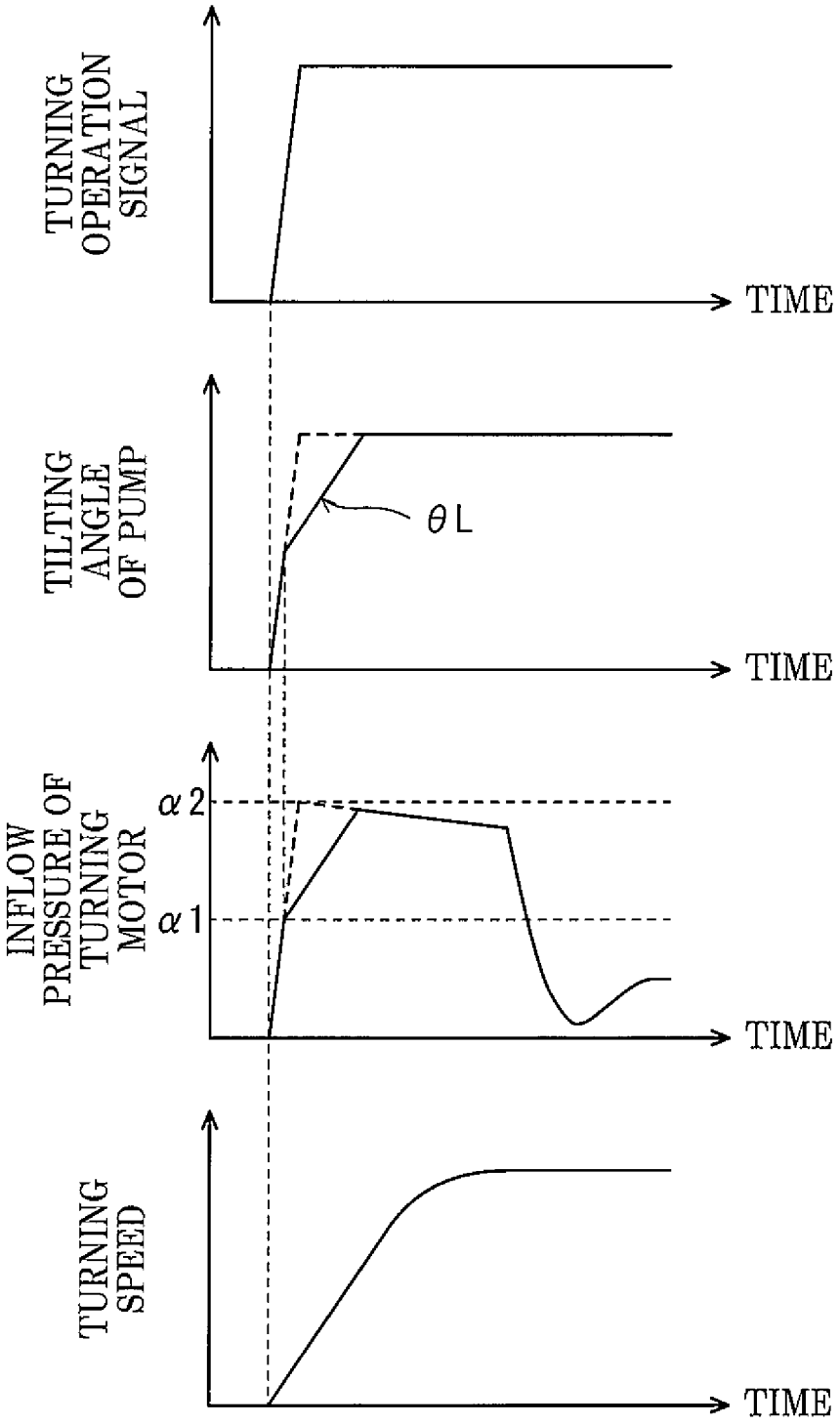
FIGS. 3A to 3D each show a graph at the time of turning acceleration.

In a case where the turning operation signal increases as shown in FIG. 3A, the controller 6 shifts to the acceleration shock reducing control. It should be noted that the condition to be satisfied in order for the controller 6 to shift to the acceleration shock reducing control may be defined to not only include that the turning operation signal increases, but further include that the inflow pressure of the turning motor 4, which is detected by the pressure sensor (61 or 62), is higher than or equal to a predetermined value.

After shifting to the acceleration shock reducing control, as shown in FIGS. 3B and 3C, the controller 6 does not regulate the rate of change (unit: deg/s) in the tilting angle of the pump 2 until the inflow pressure of the turning motor 4, which is detected by the pressure sensor (61 or 62), becomes a first threshold $\alpha 1$. That is, the controller 6 controls the flow rate adjuster 21, such that the tilting angle of the pump 2 increases to a target tilting angle in substantially the same amount of time as the increase time of the turning operation signal. However, when the inflow pressure of the turning motor 4 is higher than the first threshold $\alpha 1$, the controller 6 controls the flow rate adjuster 21, such that the rate of change in the tilting angle of the pump 2 is kept to be less than or equal to a limiting value $\theta L$. In the present embodiment, the limiting value $\theta L$ is a predetermined constant value. It should be noted that when the inflow pressure of the turning motor 4 reaches a second threshold $\alpha 2$ higher than the first threshold $\alpha 1$, the controller 6 stops keeping the rate of change in the tilting angle of the pump 2 to be less than or equal to the limiting value $\theta L$.

For the turning direction switching valve 3, the controller 6 feeds the command current to the driver 32, such that the spool 31 moves to a target position in substantially the same amount of time as the increase time of the turning operation signal.

By performing the acceleration shock reducing control as described above, at the time of turning acceleration, if the inflow pressure of the turning motor 4 becomes higher than or equal to the first threshold $\alpha 1$, the rising of the delivery flow rate of the pump 2 in response to the turning operation signal is delayed. Therefore, the inflow pressure of the turning motor 4 increases slowly from the first threshold $\alpha 1$ to the second upper limit pressure defined by the relief valve 44. This makes it possible to reduce a shock occurring at the time of turning acceleration without using a relief valve having a pressure increase shock reducing function.

(2) Deceleration Shock Reducing Control

First, the controller 6 determines whether the turning operation signal outputted from the turning operation device 5 decreases or not. When the turning operation signal decreases, the controller 6 decreases the amount of displacement of the spool 31 of the turning direction switching valve 3 from the neutral position. Accordingly, as shown in FIG. 4D, the turning speed of the construction machine 10 decreases gradually.

Figures 4A, 4B, 4C, 4D:
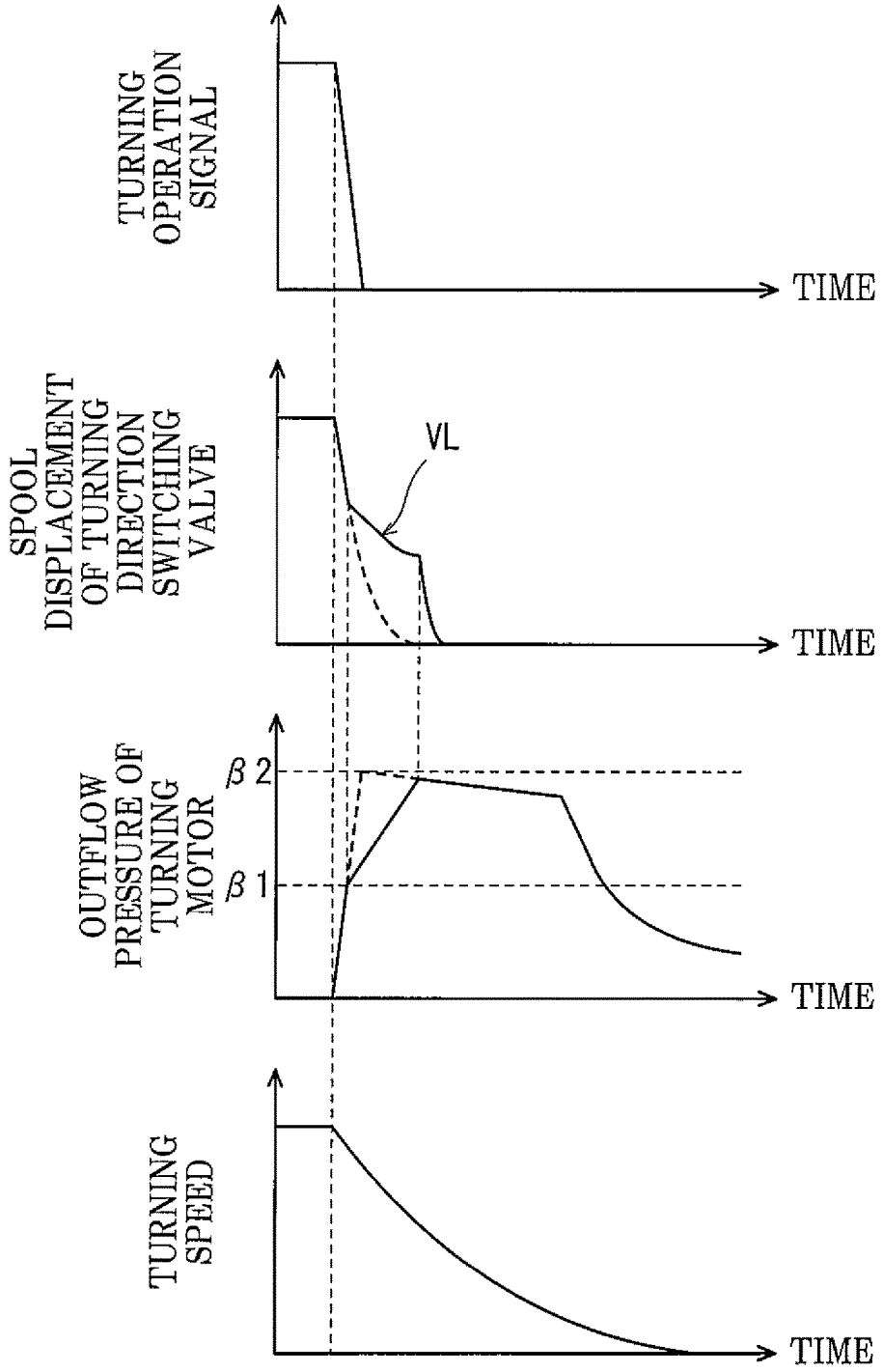
FIGS. 4A to 4D each show a graph at the time of turning deceleration.

In a case where the turning operation signal decreases as shown in FIG. 4A, the controller 6 shifts to the deceleration shock reducing control. It should be noted that the condition to be satisfied in order for the controller 6 to shift to the deceleration shock reducing control may be defined to not only include that the turning operation signal decreases, but further include that the outflow pressure of the turning motor 4, which is detected by the pressure sensor (61 or 62), is higher than or equal to a predetermined value.

After shifting to the deceleration shock reducing control, as shown in FIGS. 4B and 4C, the controller 6 does not regulate the moving speed (unit: mm/s) of the spool 31 of the turning direction switching valve 3 until the outflow pressure of the turning motor 4, which is detected by the pressure sensor (61 or 62), becomes a first threshold $\beta 1$. That is, the controller 6 feeds the command current to the driver 32 of the turning direction switching valve 3, such that the spool 31 moves to a target position (the target position is the neutral position in a case where the turning operation signal becomes zero) in substantially the same amount of time as the decrease time of the turning operation signal. However, when the outflow pressure of the turning motor 4 is higher than the first threshold $\beta 1$ and is increasing, the controller 6 feeds the command current to the driver 32, such that the moving speed of the spool 31 is kept to be less than or equal to a limiting value VL. In the present embodiment, the limiting value VL is a predetermined constant value. It should be noted that when the outflow pressure of the turning motor 4 reaches a second threshold $\beta 2$ higher than the first threshold $\beta 1$, the controller 6 stops limiting the moving speed of the spool 31, i.e., stops keeping the moving speed of the spool 31 to be less than or equal to the limiting value VL.

When the increase in the outflow pressure of the turning motor 4 beyond the first threshold $\beta 1$ ends, the controller 6 stops limiting the moving speed of the spool 31. As a result, as shown in FIG. 4B, the spool 31 moves toward the target position at a fast speed again.

For the flow rate adjuster 21, the controller 6 controls the flow rate adjuster 21, such that the tilting angle of the pump 2 decreases to a target tilting angle in substantially the same amount of time as the decrease time of the turning operation signal.

By performing the deceleration shock reducing control as described above, at the time of turning deceleration, if the outflow pressure of the turning motor 4 becomes higher than or equal to the first threshold β1, the closing action of the turning direction switching valve 3 in response to the turning operation signal is delayed. Therefore, the outflow pressure of the turning motor 4 increases slowly from the first threshold β1 to the second upper limit pressure defined by the relief valve 44. This makes it possible to reduce a shock occurring at the time of turning deceleration without using a relief valve having a pressure increase shock reducing function.

As described above, in the present embodiment, since it is not necessary to use a relief valve having a pressure increase shock reducing function, the relief valve 44, which is small in size and inexpensive, can be used. Further, in the present embodiment, the manner of rising of the inflow pressure of the turning motor 4 at the time of turning acceleration, and the manner of rising of the outflow pressure of the turning motor 4 at the time of turning deceleration, can be freely set by electronic control adjustments. This makes it possible, for example, to readily perform calibration to compensate for the influence of the hydraulic liquid temperature for each construction machine, and to make adjustments to suit the operator's preferences. Thus, operability when starting turning and when stopping turning can be adjusted to a greater degree.

<Variations>

In the above-described embodiment, both the acceleration shock reducing control and the deceleration shock reducing control are performed. Alternatively, only one of these controls may be performed. For example, in a case where only the acceleration shock reducing control is performed, the turning direction switching valve 3 need not include the driver 32, and the turning operation device 5 may be a pilot operation valve that outputs a pilot pressure as the turning operation signal to the turning direction switching valve 3. In this case, the pilot pressure outputted from the turning operation device 5 is detected by a pressure sensor, and inputted to the controller 6.

Further, in a case where only the acceleration shock reducing control is performed, instead of the pressure sensors 61 and 62 provided on the supply/discharge lines 41 and 42, a pressure sensor provided on the supply line 11 and detecting the delivery pressure of the pump 2 may be adopted. In this case, when the delivery pressure of the pump 2 is higher than the first threshold α1, the controller 6 controls the flow rate adjuster 21 so as to limit the rate of change in the tilting angle of the pump 2 to be less than or equal to the limiting value θL.

By performing the acceleration shock reducing control as described above, at the time of turning acceleration, if the delivery pressure of the pump 2 becomes higher than or equal to the first threshold α1, the rising of the delivery flow rate of the pump 2 in response to the turning operation signal is delayed. Therefore, the inflow pressure of the turning motor 4 increases slowly from the first threshold α1 to the second upper limit pressure defined by the relief valve 44. This makes it possible to reduce a shock occurring at the time of turning acceleration without using a relief valve having a pressure increase shock reducing function.

It should be noted that in the case of adopting the pressure sensor that detects the delivery pressure of the pump 2, the condition to be satisfied in order for the controller 6 to shift to the acceleration shock reducing control may be defined to not only include that the turning operation signal increases, but further include that the delivery pressure of the pump 2, which is detected by the pressure sensor, is higher than or equal to a predetermined value.

In the above-described embodiment, in the acceleration shock reducing control, the limiting value θL of the rate of change in the tilting angle of the pump 2 is a predetermined constant value. However, as an alternative, based on the inflow pressure of the turning motor 4, which is detected by the pressure sensor (61 or 62) (or in the case of adopting the pressure sensor that detects the delivery pressure of the pump 2, based on the delivery pressure of the pump 2), the controller 6 may adjust the limiting value θL by feedforward control or feedback control. According to this configuration, a shock occurring at the time of turning acceleration can be reduced more effectively.

For example, in the case of adjusting the limiting value θL, an upper limit value and a lower limit value of the limiting value θL may be set, and the limiting value θL may be changed gradually between the upper limit value and the lower limit value.

Alternatively, based on the inflow pressure of the turning motor 4, which is detected by the pressure sensor (61 or 62) (or in the case of adopting the pressure sensor that detects the delivery pressure of the pump 2, based on the delivery pressure of the pump 2), the controller 6 may calculate a correction value for a command value of the tilting angle of the pump 2, and add or subtract the correction value to or from the command value, or multiply the command value by the correction value, thereby adjusting the command value of the tilting angle of the pump 2 to be less than or equal to a predetermined limiting value.

In the above-described embodiment, in the deceleration shock reducing control, the limiting value VL of the moving speed of the spool 31 is a constant value. However, as an alternative, based on the outflow pressure of the turning motor 4, which is detected by the pressure sensor (61 or 62), the controller 6 may adjust the limiting value VL by feedforward control or feedback control. According to this configuration, a shock occurring at the time of turning deceleration can be reduced more effectively.

For example, in the case of adjusting the limiting value VL, an upper limit value and a lower limit value of the limiting value VL may be set, and the limiting value VL may be changed gradually between the upper limit value and the lower limit value. Alternatively, a correction value may be added to or subtracted from a particular limiting value VL, or the particular limiting value VL may be multiplied by the correction value.

Embodiment 2

Figure 5:
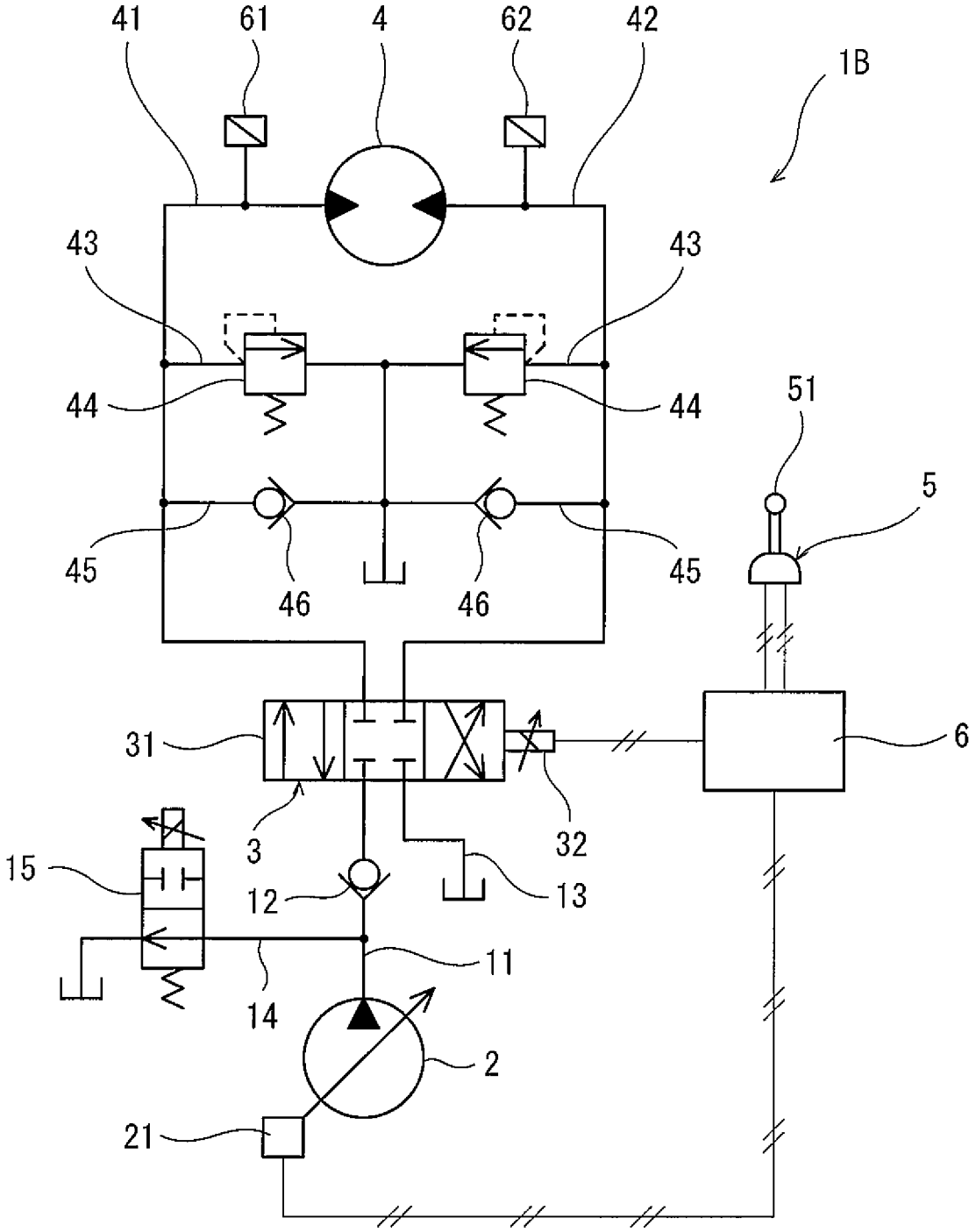
FIG. 5 shows a schematic configuration of a hydraulic drive system of a construction machine according to Embodiment 2 of the present invention.

FIG. 5 shows a hydraulic system 1B of a construction machine according to Embodiment 2 of the present invention. It should be noted that, in the present embodiment, the same components as those described in Embodiment 1 are denoted by the same reference signs as those used in Embodiment 1, and repeating the same descriptions is avoided.

In the present embodiment, an unloading line 14 is branched off from the supply line 11 at a position upstream of the check valve 12. The unloading line 14 connects to the tank. The unloading line 14 is provided with an unloading valve 15.

The unloading valve 15 is driven by an electrical signal. To be more specific, the unloading valve 15 is fully open when it is in a neutral state. The unloading valve 15 decreases its opening degree toward a fully closed state in accordance with increase in a command current fed to the unloading valve 15.

The unloading valve 15 is controlled by the controller 6. The controller 6 controls the unloading valve 15, such that the opening degree of the unloading valve 15 decreases in accordance with increase in the operation signal outputted from the turning operation device 5.

In addition, the controller 6 performs acceleration shock reducing control that is different from the one described in Embodiment 1.

First, the controller 6 determines whether the turning operation signal outputted from the turning operation device 5 increases or not. When the turning operation signal increases, the controller 6 increases the amount of displacement of the spool 31 of the turning direction switching valve 3 from the neutral position. Accordingly, as shown in FIG. 6D, the turning speed of the construction machine 10 increases gradually.

Figures 6A, 6B, 6C, 6D:
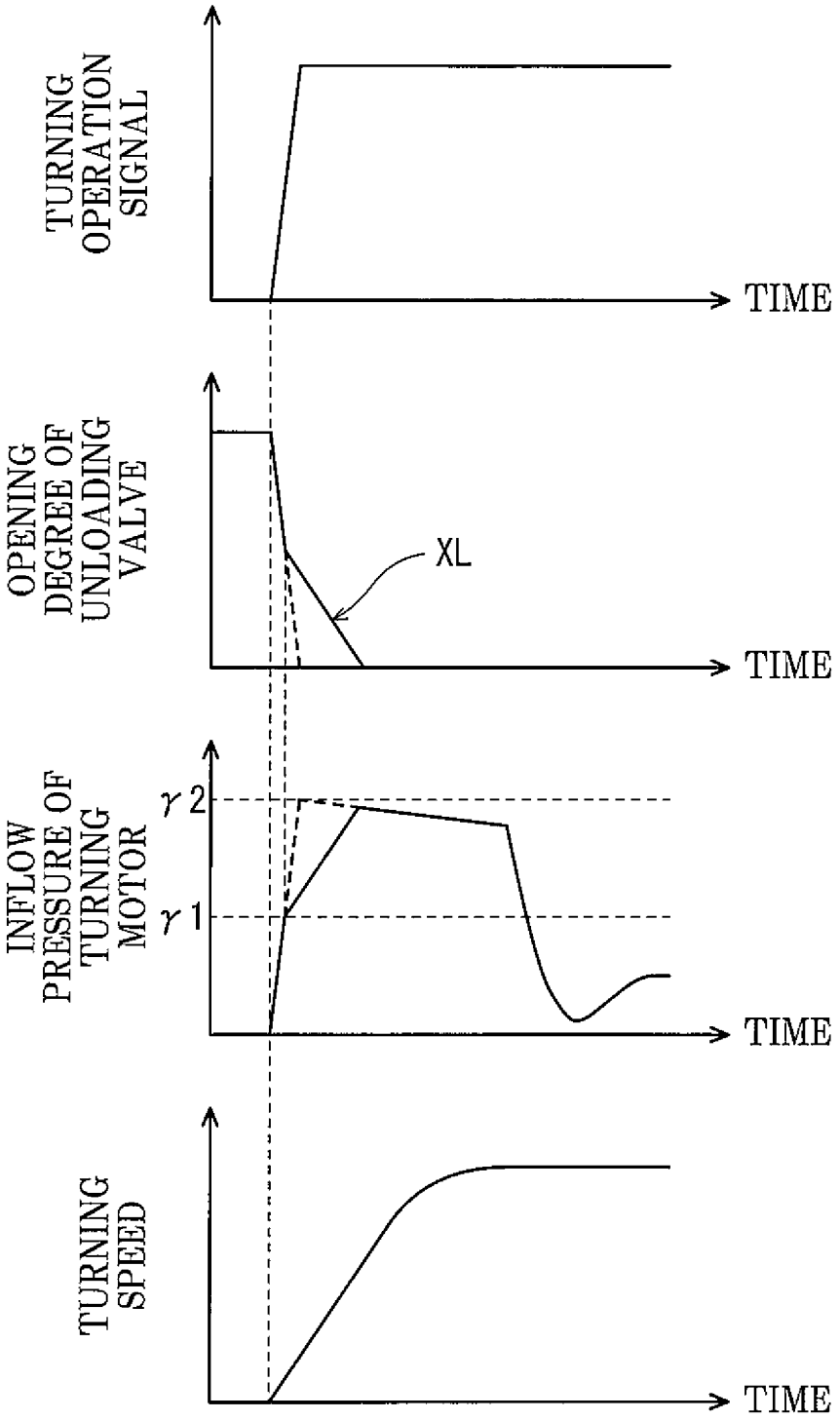
FIGS. 6A to 6D each show a graph at the time of turning acceleration.

In a case where the turning operation signal increases as shown in FIG. 6A, the controller 6 shifts to the acceleration shock reducing control. It should be noted that the condition to be satisfied in order for the controller 6 to shift to the acceleration shock reducing control may be defined to not only include that the turning operation signal increases, but further include that the inflow pressure of the turning motor 4, which is detected by the pressure sensor (61 or 62), is higher than or equal to a predetermined value.

After shifting to the acceleration shock reducing control, as shown in FIGS. 6B and 6C, the controller 6 does not regulate the rate of change (unit: deg/s) in the opening degree of the unloading valve 15 until the inflow pressure of the turning motor 4, which is detected by the pressure sensor (61 or 62), becomes a first threshold γ1. That is, the controller 6 controls the unloading valve 15, such that the opening degree of the unloading valve 15 decreases to a target opening degree in substantially the same amount of time as the increase time of the turning operation signal. However, when the inflow pressure of the turning motor 4 is higher than the first threshold γ1, the controller 6 controls the unloading valve 15, such that the rate of change in the opening degree of the unloading valve 15 is kept to be less than or equal to a limiting value XL. In the present embodiment, the limiting value XL is a predetermined constant value. It should be noted that when the inflow pressure of the turning motor 4 reaches a second threshold γ2 higher than the first threshold γ1, the controller 6 stops keeping the rate of change in the opening degree of the unloading valve 15 to be less than or equal to the limiting value XL.

For the flow rate adjuster 21, the controller 6 controls the flow rate adjuster 21, such that the tilting angle of the pump 2 increases to a target tilting angle in substantially the same amount of time as the increase time of the turning operation signal. For the turning direction switching valve 3, the controller 6 feeds the command current to the driver 32, such that the spool 31 moves to a target position in substantially the same amount of time as the increase time of the turning operation signal.

By performing the acceleration shock reducing control as described above, at the time of turning acceleration, if the inflow pressure of the turning motor 4 becomes higher than or equal to the first threshold γ1, the closing action of the unloading valve 15 in response to the turning operation signal is delayed, and the rising of the amount of hydraulic liquid supplied to the turning motor 4 is delayed. Therefore, the inflow pressure of the turning motor 4 increases slowly from the first threshold γ1 to the second upper limit pressure defined by the relief valve 44. This makes it possible to reduce a shock occurring at the time of turning acceleration without using a relief valve having a pressure increase shock reducing function.

<Variations>

In FIG. 5, the turning direction switching valve 3 includes the driver 32, and the turning operation device 5 is an electrical joystick. Alternatively, similar to the variation of Embodiment 1, the turning direction switching valve 3 need not include the driver 32, and the turning operation device 5 may be a pilot operation valve that outputs a pilot pressure as the turning operation signal to the turning direction switching valve 3.

Instead of the pressure sensors 61 and 62 provided on the supply/discharge lines 41 and 42, a pressure sensor provided on the supply line 11 and detecting the delivery pressure of the pump 2 may be adopted. In this case, when the delivery pressure of the pump 2 is higher than the first threshold γ1, the controller 6 controls the unloading valve 15 so as to limit the rate of change in the opening degree of the unloading valve 15 to be less than or equal to the limiting value XL.

By performing the acceleration shock reducing control as described above, at the time of turning acceleration, if the delivery pressure of the pump 2 becomes higher than or equal to the first threshold γ1, the closing action of the unloading valve 15 in response to the turning operation signal is delayed, and the rising of the amount of hydraulic liquid supplied to the turning motor 4 is delayed. Therefore, the inflow pressure of the turning motor 4 increases slowly from the first threshold γ1 to the second upper limit pressure defined by the relief valve 44. This makes it possible to reduce a shock occurring at the time of turning acceleration without using a relief valve having a pressure increase shock reducing function.

It should be noted that in the case of adopting the pressure sensor that detects the delivery pressure of the pump 2, the condition to be satisfied in order for the controller 6 to shift to the acceleration shock reducing control may be defined to not only include that the turning operation signal increases, but further include that the delivery pressure of the pump 2, which is detected by the pressure sensor, is higher than or equal to a predetermined value.

In the above-described embodiment, in the acceleration shock reducing control, the limiting value XL of the rate of change in the opening degree of the unloading valve 15 is a predetermined constant value. However, as an alternative, based on the inflow pressure of the turning motor 4, which is detected by the pressure sensor (61 or 62) (or in the case of adopting the pressure sensor that detects the delivery pressure of the pump 2, based on the delivery pressure of the pump 2), the controller 6 may adjust the limiting value XL by feedforward control or feedback control. According to this configuration, a shock occurring at the time of turning acceleration can be reduced more effectively.

For example, in the case of adjusting the limiting value XL, an upper limit value and a lower limit value of the limiting value XL may be set, and the limiting value XL may be changed gradually between the upper limit value and the lower limit value.

Alternatively, based on the inflow pressure of the turning motor 4, which is detected by the pressure sensor (61 or 62) (or in the case of adopting the pressure sensor that detects the delivery pressure of the pump 2, based on the delivery pressure of the pump 2), the controller 6 may calculate a correction value for a command value of the opening degree of the unloading valve 15, and add or subtract the correction value to or from the command value, or multiply the command value by the correction value, thereby adjusting the command value of the opening degree of the unloading valve 15 to be less than or equal to a predetermined limiting value.

Other Embodiments

The present invention is not limited to the above-described embodiments. Various modifications can be made without departing from the scope of the present invention.

REFERENCE SIGNS LIST

1A, 1B hydraulic drive system
11 supply line
14 unloading line
15 unloading valve
2 pump
21 flow rate adjuster
3 turning direction switching valve
31 spool
32 driver
4 turning motor
5 turning operation device
51 operating lever
6 controller
61, 62 pressure sensor

The invention claimed is:

1. A hydraulic drive system of a construction machine, comprising:

a turning motor;

a turning operation device including an operating lever, the turning operation device outputting a turning operation signal corresponding to an inclination angle of the operating lever;

a turning direction switching valve including a spool and a driver, the driver receiving a command current and driving the spool, the turning direction switching valve increasing an amount of a hydraulic liquid supplied to the turning motor and an amount of the hydraulic liquid discharged from the turning motor in accordance with increase in the command current;

a controller that feeds the command current to the turning direction switching valve, such that the command current increases in accordance with increase in the turning operation signal; and a pressure sensor that detects an outflow pressure of the turning motor, wherein in a case where the turning operation signal decreases, when the outflow pressure of the turning motor, which is detected by the pressure sensor, is higher than a threshold and is increasing, the controller feeds the command current to the turning direction switching valve, such that a moving speed of the spool is kept to be less than or equal to a limiting value to reduce a speed of increase in the outflow pressure of the turning motor.

2. The hydraulic drive system of a construction machine according to claim 1, wherein the controller adjusts the limiting value by feedforward control or feedback control based on the outflow pressure of the turning motor, which is detected by the pressure sensor.

3. The hydraulic drive system of a construction machine according to claim 1, further comprising:

a variable displacement pump connected to the turning direction switching valve by a supply line;

a flow rate adjuster that adjusts a tilting angle of the pump; and a pressure sensor that detects a delivery pressure of the pump or an inflow pressure of the turning motor, wherein the controller controls the flow rate adjuster, such that a delivery flow rate of the pump increases in accordance with increase in the turning operation signal, and in a case where the turning operation signal increases, when the delivery pressure of the pump or the inflow pressure of the turning motor, which is detected by the pressure sensor, is higher than a threshold, the controller controls the flow rate adjuster, such that a rate of change in the tilting angle of the pump, or a command value of the tilting angle of the pump, is kept to be less than or equal to a limiting value.

4. The hydraulic drive system of a construction machine according to claim 1, further comprising:

a variable displacement pump connected to the turning direction switching valve by a supply line;

a flow rate adjuster that adjusts a tilting angle of the pump;

an unloading valve provided on an unloading line that is branched off from the supply line; and a pressure sensor that detects a delivery pressure of the pump or an inflow pressure of the turning motor, wherein the controller controls the flow rate adjuster such that a delivery flow rate of the pump increases in accordance with increase in the turning operation signal, and controls the unloading valve such that an opening degree of the unloading valve decreases in accordance with increase in the turning operation signal, and in a case where the turning operation signal increases, when the delivery pressure of the pump or the inflow pressure of the turning motor, which is detected by the pressure sensor, is higher than a threshold, the controller controls the unloading valve, such that a rate of change in the opening degree of the unloading valve, or a command value of the opening degree of the unloading valve, is kept to be less than or equal to a limiting value.

5. A hydraulic drive system of a construction machine, comprising:

a turning motor;

a turning operation device including an operating lever, the turning operation device outputting a turning operation signal corresponding to an inclination angle of the operating lever;

a turning direction switching valve that increases an amount of a hydraulic liquid supplied to the turning motor and an amount of the hydraulic liquid discharged from the turning motor in accordance with increase in the turning operation signal;

a variable displacement pump connected to the turning direction switching valve by a supply line;

a flow rate adjuster that adjusts a tilting angle of the pump;

a controller that controls the flow rate adjuster, such that a delivery flow rate of the pump increases in accordance with increase in the turning operation signal; and a pressure sensor that detects a delivery pressure of the pump or an inflow pressure of the turning motor, wherein in a case where the turning operation signal increases, when the delivery pressure of the pump or the inflow pressure of the turning motor, which is detected by the pressure sensor, is higher than a threshold, the controller controls the flow rate adjuster, such that a rate of change in the tilting angle of the pump, or a command value of the tilting angle of the pump, is kept to be less than or equal to a limiting value to delay increase of the delivery flow rate of the pump in response to the turning operation signal.

6. The hydraulic drive system of a construction machine according to claim 5, wherein the controller adjusts the limiting value by feedforward control or feedback control based on the delivery pressure of the pump or the inflow pressure of the turning motor, which is detected by the pressure sensor.

7. A hydraulic drive system of a construction machine, comprising:

a turning motor;

a turning operation device including an operating lever, the turning operation device outputting a turning operation signal corresponding to an inclination angle of the operating lever;

a turning direction switching valve that increases an amount of a hydraulic liquid supplied to the turning motor and an amount of the hydraulic liquid discharged from the turning motor in accordance with increase in the turning operation signal;

a variable displacement pump connected to the turning direction switching valve by a supply line;

a flow rate adjuster that adjusts a tilting angle of the pump;

an unloading valve provided on an unloading line that is branched off from the supply line;

a controller that controls the flow rate adjuster such that a delivery flow rate of the pump increases in accordance with increase in the turning operation signal, and controls the unloading valve such that an opening degree of the unloading valve decreases in accordance with increase in the turning operation signal; and a pressure sensor that detects a delivery pressure of the pump or an inflow pressure of the turning motor, wherein in a case where the turning operation signal increases, when the delivery pressure of the pump or the inflow pressure of the turning motor, which is detected by the pressure sensor, is higher than a threshold, the controller controls the unloading valve, such that a rate of change in the opening degree of the unloading valve, or a command value of the opening degree of the unloading valve, is kept to be less than or equal to a limiting value to delay a closing action of the unloading valve in response to the turning operation signal.

8. The hydraulic drive system of a construction machine according to claim 7, wherein the controller adjusts the limiting value by feedforward control or feedback control based on the delivery pressure of the pump or the inflow pressure of the turning motor, which is detected by the pressure sensor.

9. A hydraulic drive system of a construction machine, comprising:

a turning motor;

a turning operation device including an operating lever, the turning operation device outputting a turning operation signal corresponding to an inclination angle of the operating lever;

a turning direction switching valve including a spool and a driver, the driver receiving a command current and driving the spool, the turning direction switching valve increasing an amount of a hydraulic liquid supplied to the turning motor and an amount of the hydraulic liquid discharged from the turning motor in accordance with increase in the command current;

a controller that feeds the command current to the turning direction switching valve, such that the command current increases in accordance with increase in the turning operation signal; and a pressure sensor that detects an outflow pressure of the turning motor, wherein in a case where the turning operation signal decreases, when the outflow pressure of the turning motor, which is detected by the pressure sensor, is higher than a threshold and is increasing, the controller feeds the command current to the turning direction switching valve, such that a moving speed of the spool is kept to be less than or equal to a limiting value, wherein the controller adjusts the limiting value by feedforward control or feedback control based on the outflow pressure of the turning motor, which is detected by the pressure sensor, and wherein the hydraulic drive system further comprises:

a variable displacement pump connected to the turning direction switching valve by a supply line;

a flow rate adjuster that adjusts a tilting angle of the pump; and a pressure sensor that detects a delivery pressure of the pump or an inflow pressure of the turning motor, wherein the controller controls the flow rate adjuster, such that a delivery flow rate of the pump increases in accordance with increase in the turning operation signal, and in a case where the turning operation signal increases, when the delivery pressure of the pump or the inflow pressure of the turning motor, which is detected by the pressure sensor, is higher than a threshold, the controller controls the flow rate adjuster, such that a rate of change in the tilting angle of the pump, or a command value of the tilting angle of the pump, is kept to be less than or equal to a limiting value.

10. A hydraulic drive system of a construction machine, comprising:

a turning motor;

a turning operation device including an operating lever, the turning operation device outputting a turning operation signal corresponding to an inclination angle of the operating lever;

a turning direction switching valve including a spool and a driver, the driver receiving a command current and driving the spool, the turning direction switching valve increasing an amount of a hydraulic liquid supplied to the turning motor and an amount of the hydraulic liquid discharged from the turning motor in accordance with increase in the command current;

a controller that feeds the command current to the turning direction switching valve, such that the command current increases in accordance with increase in the turning operation signal; and a pressure sensor that detects an outflow pressure of the turning motor, wherein in a case where the turning operation signal decreases, when the outflow pressure of the turning motor, which is detected by the pressure sensor, is higher than a threshold and is increasing, the controller feeds the command current to the turning direction switching valve, such that a moving speed of the spool is kept to be less than or equal to a limiting value, wherein the controller adjusts the limiting value by feedforward control or feedback control based on the outflow pressure of the turning motor, which is detected by the pressure sensor, and wherein the hydraulic drive system further comprises:

a variable displacement pump connected to the turning direction switching valve by a supply line;

a flow rate adjuster that adjusts a tilting angle of the pump;

an unloading valve provided on an unloading line that is branched off from the supply line; and a pressure sensor that detects a delivery pressure of the pump or an inflow pressure of the turning motor, wherein the controller controls the flow rate adjuster such that a delivery flow rate of the pump increases in accordance with increase in the turning operation signal, and controls the unloading valve such that an opening degree of the unloading valve decreases in accordance with increase in the turning operation signal, and in a case where the turning operation signal increases, when the delivery pressure of the pump or the inflow pressure of the turning motor, which is detected by the pressure sensor, is higher than a threshold, the controller controls the unloading valve, such that a rate of change in the opening degree of the unloading valve, or a command value of the opening degree of the unloading valve, is kept to be less than or equal to a limiting value.

* * * * *